US006863212B2

(12) United States Patent
Stone et al.

(10) Patent No.: US 6,863,212 B2
(45) Date of Patent: Mar. 8, 2005

(54) RECLOSABLE CONTAINER

(75) Inventors: James L. Stone, Grand Rapids, MI (US); Thomas J. Brink, Wyoming, MI (US); Scott A. Lampe, Wyoming, MI (US)

(73) Assignee: Caraustar Custom Packaging, Grand Rapids, MI (US)

( * ) Notice: Subject to any disclaimer, the term of this patent is extended or adjusted under 35 U.S.C. 154(b) by 144 days.

(21) Appl. No.: 10/385,963

(22) Filed: Mar. 11, 2003

(65) Prior Publication Data

US 2004/0178252 A1 Sep. 16, 2004

(51) Int. Cl.[7] ..... B65D 5/20; B65D 43/16

(52) U.S. Cl. ..... 229/128; 229/114; 229/116.1; 229/154; 229/155; 493/162

(58) Field of Search ..... 229/116.1, 114, 229/128, 152, 154, 155; 493/162

(56) References Cited

U.S. PATENT DOCUMENTS

| | | | | |
|---|---|---|---|---|
| 667,634 A | * | 2/1901 | Schmidt | 229/128 |
| 887,729 A | | 5/1908 | Kirmse | |
| 900,953 A | | 10/1908 | Reber | |
| 901,286 A | | 10/1908 | Ferres et al. | |
| 1,430,149 A | | 9/1922 | Bliss | |
| 1,995,286 A | | 3/1935 | Arzet | |
| 1,998,717 A | | 4/1935 | Guyer | |
| 2,011,438 A | | 8/1935 | Daller | |
| 2,210,707 A | * | 8/1940 | Russell | 229/152 |
| 2,348,377 A | | 5/1944 | Goodyear | |
| 2,367,476 A | | 1/1945 | Tyrseck | |
| 2,369,387 A | | 2/1945 | Williamson et al. | |
| 2,369,392 A | | 2/1945 | Ringler | |
| 2,396,310 A | | 3/1946 | Yungblut | |
| 2,403,698 A | | 7/1946 | Williamson et al. | |
| 2,502,117 A | | 3/1950 | Anderson | |

(List continued on next page.)

FOREIGN PATENT DOCUMENTS

| | | |
|---|---|---|
| CA | 1017728 | 9/1977 |
| CA | 1323608 | 10/1993 |
| DE | 2002995 | 7/1971 |
| DE | 2046484 | 3/1972 |
| DE | 3140389 A1 | 6/1983 |
| GB | 2229996 A | 10/1990 |
| JP | 5-97151 | 4/1993 |

*Primary Examiner*—Gary E. Elkins
(74) *Attorney, Agent, or Firm*—Summa & Allan, P.A.

(57) ABSTRACT

A container is provided with a simple opening and closure mechanism which provides for easy reclosure of the container. A user may grasp a reclosable flap and move the flap between open and closed positions to effect opening and closure of the container. The reclosable flap may overlay a container lid such that the container lid is kept in a closed position when the reclosable flap overlays the container lid with the reclosable flap in its closed position. The container may be open and closed several times, and a seal may be maintained in the vicinity of the reclosable flap even after multiple uses of the container.

15 Claims, 4 Drawing Sheets

U.S. PATENT DOCUMENTS 2,717,074 A 9/1955 Williams
2,766,923 A 10/1956 D'Esposito
2,794,588 A 6/1957 George et al.
2,836,343 A 5/1958 Will
2,848,153 A 8/1958 Geiger Sr.
2,872,855 A 2/1959 Fahrenkrug
2,881,967 A 4/1959 Ringler
2,939,621 A 6/1960 Mittleman
2,951,627 A 9/1960 Wenzel
2,983,424 A 5/1961 Glass
3,008,569 A 11/1961 Murch
3,023,679 A 3/1962 Piazze
3,085,736 A 4/1963 Meyers
3,140,809 A 7/1964 Hickin et al.
3,161,346 A 12/1964 Svensson
3,168,974 A 2/1965 Buttery et al.
3,172,563 A 3/1965 Harwood
3,197,114 A 7/1965 Holmes
3,197,115 A 7/1965 Peter
3,198,420 A 8/1965 Hiersteiner
3,207,416 A 9/1965 Kotlz et al. ..... 229/68
3,249,283 A 5/1966 Craddock et al.
3,295,743 A 1/1967 Redpath et al.
3,321,354 A 5/1967 Sloan et al. ..... 156/499
3,322,264 A 5/1967 NcNair et al. ..... 206/45.25
3,343,660 A * 9/1967 Bailey ..... 229/114
3,345,918 A 10/1967 Simeone
3,355,995 A 12/1967 Borkmann et al.
RE26,371 E 4/1968 Schultz
3,385,428 A 5/1968 Kugler
3,432,090 A 3/1969 Engel
3,434,849 A 3/1969 Carbone
3,465,944 A 9/1969 Robinson ..... 229/5.5
3,514,032 A 5/1970 Pierce
3,524,581 A 8/1970 Buttery
3,537,360 A 11/1970 Farnam
3,708,108 A 1/1973 Rosenburg, Jr.
3,710,396 A 1/1973 Tomlinson ..... 2/197
3,727,827 A 4/1973 Stice
3,744,702 A 7/1973 Ellison
3,756,501 A 9/1973 Skillen
3,774,838 A 11/1973 Christie
3,809,310 A * 5/1974 VanderLugt, Jr. ..... 229/155
3,907,194 A 9/1975 Davenport et al.
3,910,486 A 10/1975 Stone
3,961,743 A 6/1976 Hollowell
3,963,173 A 6/1976 Stone
4,042,164 A 8/1977 Croley
4,048,052 A 9/1977 Tolaas ..... 206/625
4,083,455 A 4/1978 Keating, Jr. ..... 206/625
4,102,457 A 7/1978 Meyers
4,127,229 A 11/1978 Roccaforte
4,136,816 A 1/1979 Gardner
4,141,449 A 2/1979 Stone
4,284,193 A 8/1981 Roccaforte ..... 206/45.31
4,289,239 A 9/1981 Meyers ..... 206/625
4,314,643 A 2/1982 Forbes, Jr. ..... 206/626
4,531,669 A 7/1985 Osborne
4,542,847 A 9/1985 Lindstrom
4,679,694 A 7/1987 Donohie et al.
4,688,677 A 8/1987 Roccaforte
4,726,471 A 2/1988 Whately et al. ..... 206/554
4,732,315 A 3/1988 Gunn ..... 229/125.09
4,747,536 A 5/1988 Wischusen, III ..... 229/128
4,765,534 A * 8/1988 Zion et al. ..... 229/152
4,768,703 A 9/1988 Sosler et al. ..... 229/123.1
4,773,542 A 9/1988 Schillinger et al.
4,871,345 A 10/1989 Wosaba, II et al. ..... 493/59
4,948,038 A 8/1990 Moeller ..... 229/146
4,951,865 A * 8/1990 Eisman ..... 229/114
4,981,256 A 1/1991 Giblin et al. ..... 229/125.09
4,986,420 A 1/1991 Gunn et al.
4,997,087 A 3/1991 Lorenz ..... 206/422
5,014,905 A 5/1991 Cassidy ..... 229/113
5,036,982 A 8/1991 Aston
5,054,644 A 10/1991 Greenslade
5,061,501 A * 10/1991 Lowe ..... 229/128
5,092,516 A 3/1992 Kastanek ..... 229/226
5,129,875 A 7/1992 Chaygneaud-Dupuy ..... 493/335
5,148,973 A 9/1992 Zimmermann ..... 229/125.28
5,154,343 A 10/1992 Stone ..... 229/225
5,161,733 A 11/1992 Latif ..... 229/225
5,161,734 A 11/1992 Ruehl et al. ..... 229/227
5,170,934 A 12/1992 Lemoine ..... 229/101
5,215,248 A 6/1993 Moser
5,219,089 A 6/1993 Kiolbasa et al.
5,236,123 A 8/1993 Stone et al. ..... 229/225
5,238,179 A 8/1993 Hart ..... 229/117.13
5,249,681 A 10/1993 Miller ..... 206/427
5,265,799 A 11/1993 Stone ..... 229/225
5,277,360 A 1/1994 DeMott ..... 229/122
5,314,114 A 5/1994 Stone ..... 229/225
5,320,279 A 6/1994 Giblin et al. ..... 229/225
5,322,215 A 6/1994 Roccaforte ..... 229/225
5,325,989 A 7/1994 Karalus
5,328,091 A 7/1994 Koss ..... 229/231
5,363,981 A 11/1994 Giblin et al.
5,373,960 A 12/1994 Gunn et al.
5,439,133 A 8/1995 Stone
5,443,205 A 8/1995 Robotham et al. ..... 229/243
5,505,374 A 4/1996 Stone ..... 229/227
5,515,996 A 5/1996 Stone
5,551,938 A 9/1996 Stone ..... 493/96
5,553,772 A * 9/1996 Jensen ..... 229/114
5,553,773 A 9/1996 Focke et al. ..... 229/224
5,624,031 A 4/1997 Fowler et al. ..... 206/391
5,673,849 A 10/1997 Stone ..... 229/227
5,725,144 A 3/1998 Stone et al. ..... 229/101
5,743,462 A 4/1998 Stone ..... 229/227
5,775,576 A 7/1998 Stone ..... 229/225
5,924,626 A * 7/1999 Whitnell ..... 229/128
6,176,420 B1 * 1/2001 Sarson et al. ..... 229/128

* cited by examiner

RECLOSABLE CONTAINER

FIELD OF THE INVENTION

The present invention relates generally to packaging and more specifically relates to an easy-to-use reclosable container.

BACKGROUND OF THE INVENTION

In the container industry, specialized containers have been developed for specific applications. For example, in the food packaging industry, specific package types for cereals, frozen foods, dairy products, and other types of foods have specific packaging types that have come to be identified with the specific product. Many food products come in one-time use packages that are opened once and then discarded because there is no need for closure once the package has been opened.

For some food products, it is important to have a reusable package that can be repeatedly opened and closed. For example, a traditional cereal box is opened and closed many times over its useful life. Some reusable packages use close tabs or tacky adhesives to enable the package to be re-closed once it has been opened. Such closure mechanisms have drawbacks. For example, a tab generally sticks out from a panel and is easily deformed or ripped off, with a resulting decline or loss of effectiveness for closure. Adhesives areas may be soiled over time, resulting in reduced tackiness and, therefore, reduced closing ability. Further, previous closure types do not allow for the reliable creation of a seal when closing a package. A reliable seal is beneficial in several container applications, such as a microwave cooking application where the seal is necessary to hold in steam during cooking, or refrigeration or freezing applications in which air exchange between the container and the surrounding environment is unwelcome.

It is desirable to create a convenient container having an easy-to-use closing mechanism that overcomes these and other faults of previous containers.

SUMMARY OF THE INVENTION

According to one embodiment of the present invention, a container is provided with a closure flap attached to a container wall along a curved fold line.

According to another embodiment of the present invention, a container is provided with several curved fold lines, with one of the curved fold lines being a line of attachment between a container wall and a closure flap.

According to another embodiment of the present invention, a container is provided with a closure flap attached to a container wall along a curved fold line, such that a seal forms between the curved fold line and a container lid.

The above summary of the present invention is not intended to represent each embodiment, or every aspect, of the present invention. This is the purpose of the figures and the detailed description which follow.

BRIEF DESCRIPTION OF THE DRAWINGS

The foregoing and other advantages of the invention will become apparent upon reading the following detailed description and upon reference to the drawings.

Figure 1:
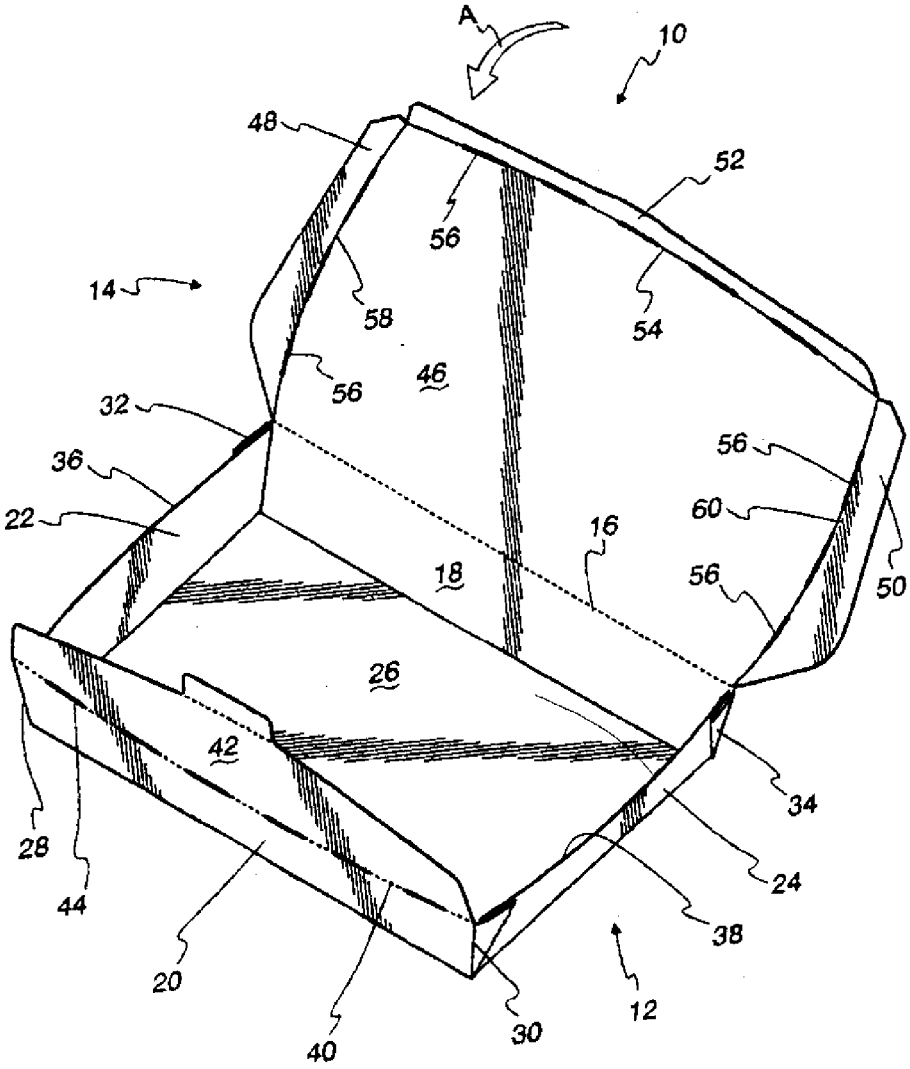
FIG. 1 is an isometric view of a container according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

The creation of an easy-to-use container with a repeatable and reliable closure is a constant goal of the packaging industry. The present invention addresses this and other concerns of the packaging industry. A container 10 according to one embodiment of the present invention is shown in FIG. 1. The container includes a base 12 and a lid 14 attached along a hinge fold line 16 to the base. The hinge fold line 16 is located along the top of a back panel 18 of the base.

The base 12 provides an enclosed volume bounded along the back by the back panel 18, along the front by a front panel 20, along the sides by first and second side panels 22 and 24, and along the bottom by a bottom panel 26. First and second front corner structures 28 and 30 provide for connection between the front panel 20 and the first and second side panels 22 and 24, respectively, and first and second back corner structures 32 and 34 provide connections between the back panel 18 and the first and second side panels 22 and 24, respectively. According to the embodiment shown in FIG. 1, the corner structures include multiple plies of material adhesively attached in a gusset-like configuration, but it is to be understood that other corner structures, such as webbed corners, locked corners, and direct adhesive or staple connections between panels are also contemplated by the present invention. According to one embodiment of the present invention, the back panel 18, the front panel 20, and the first and second side panels 22 and 24 extend upwardly from the bottom panel and slightly outwardly from the center of the container 10. According to one embodiment of the invention, the back panel 18, the front panel 20, and the first and second side panels 22 and 24 extend upwardly at an angle of approximately 100 degrees from the bottom panel 26. According to another embodiment of the present invention, the back panel 18, the front panel 20, and the first and second side panels 22 and 24 extend upwardly at angles from about 90 degrees to about 120 degrees from the bottom panel 26.

The first and second side panels 22 and 24 terminate along their tops at side panel top edges 36 and 38. In the embodiment shown in FIG. 1, the side panel top edges 36 and 38 are curved such that a slight outward bow is created in each of the first and second side panels 22 and 24.

The front panel 20 terminates along an upper edge along a curved closure flap fold line 40, with a closure flap 42 extending from the curved closure flap fold line 40. According to one embodiment of the present invention, the curved closure flap fold line 40 is provided with several score cuts 44 such that the closure flap 42 tends to fold inwardly rather than outwardly.

As shown in FIG. 1, the lid 14 includes a top panel 46 with first and second minor side flaps 48 and 50 and a minor front flap 52. In the embodiment shown in FIG. 1, the minor front flap 52 is attached to the top panel 46 along a curved minor front flap fold line 54, which may be provided with several scored areas 56 to cause the minor front flap 52 to preferentially fold inwardly toward the inside of the container 10. Similarly, the first and second minor side flaps 48 and 50 are respectively attached to the top panel 46 along first and second curved minor side flap fold lines 58 and 60, which may likewise be provided with score areas 56 to allow the first and second minor side flaps 48 and 50 to preferentially fold inwardly.

Figure 2:
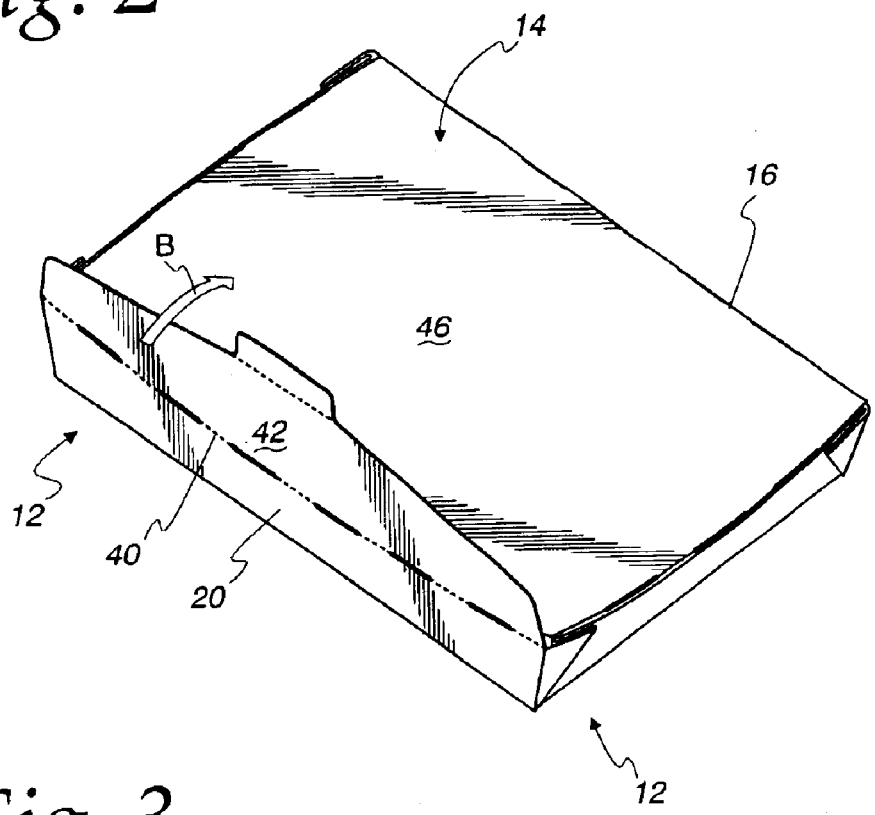
FIG. 2 is an isometric view of a container according to one embodiment of the present invention

The container 10 may be closed by folding the minor front flap 52 and the first and second minor side flaps 48 and 50 inwardly, then folding the lid 14 downwardly as shown by the arrow, "A." This results in the configuration shown in FIG. 2, in which the lid 14 is closed over the base 12. Pushing the lid 14 into this position causes a slight outward bowing of the front panel 20, along with a slight outward bowing of the curved closure flap fold line 40. As a result, the closure flap 42 protrudes upwardly and slightly outwardly from the lid 14.

At this point, the closure flap 42 may be folded in the direction shown by the arrow "B" in FIG. 2 into a closed position over the top panel 46. The outward bowing of the front panel 20 and the curved closure flap fold line 40 cause a downward force on the closure flap 42, holding the closure flap 42 in the closed position shown in FIG. 3. When the closure flap 42 is in its closed position, the container 10 is tightly sealed against moisture escaping from the container 10 and further against air exchange between the container 10 and the surrounding atmosphere. The container 10 is not hermetically sealed at this point—it will allow some moisture and air to pass from the container 10 to the surrounding atmosphere—but the seal is sufficient for many applications, including food storage, refrigeration or freezing, and cooking in an oven or microwave oven, or both in a dual-ovenable configuration.

Figure 3:
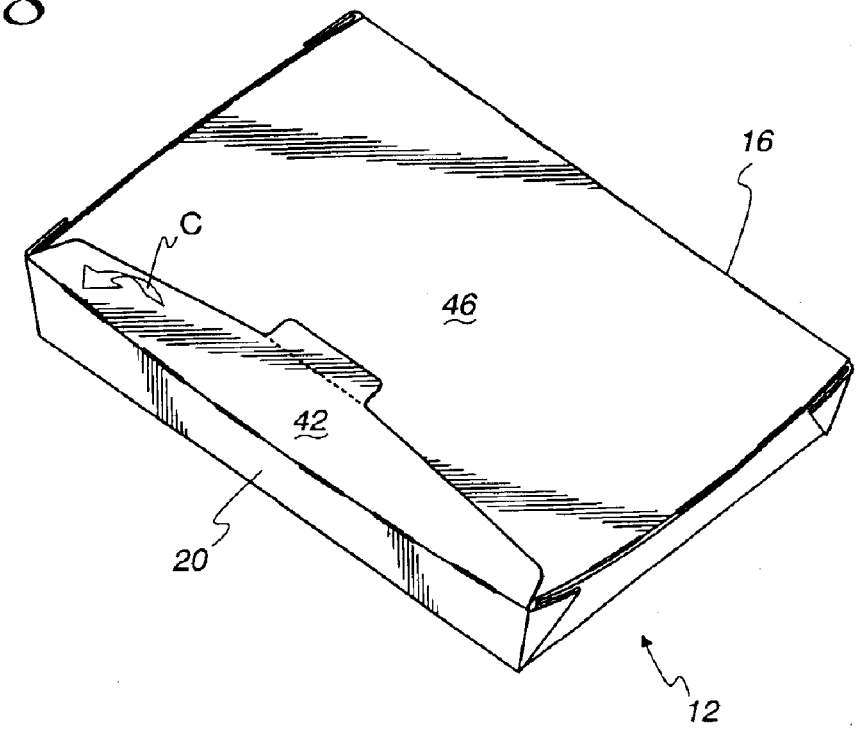
FIG. 3 is an isometric view of a container according to one embodiment of the invention.
Figure 4:
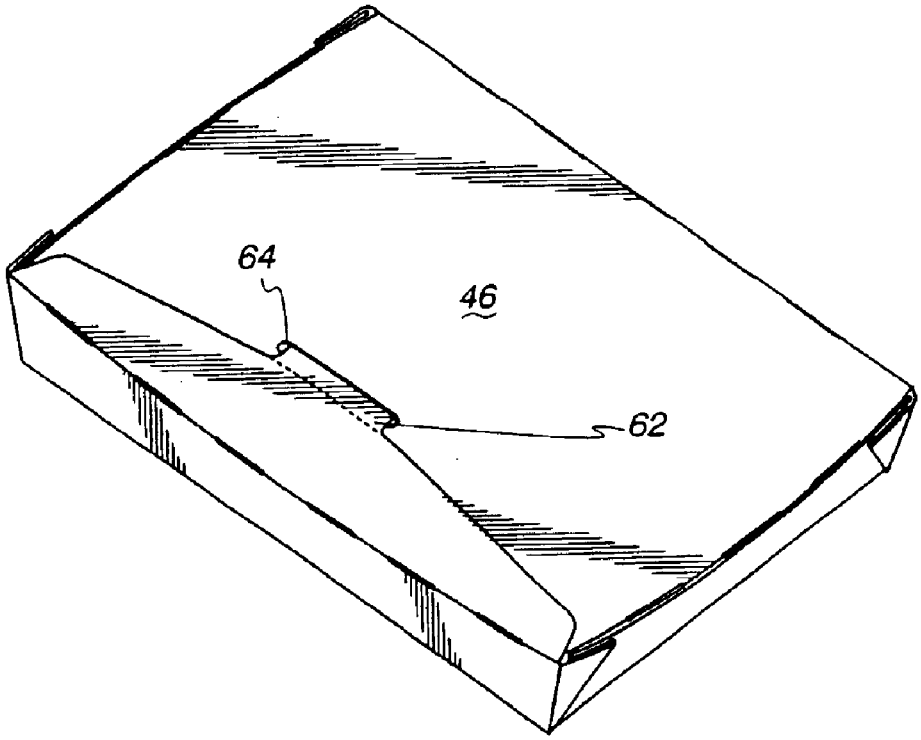
FIG. 4 is an isometric view of a container according to another embodiment of the present invention.

As shown in FIG. 3, the closure flap 42 may be easily returned to an open position by folding the closure flap in the direction of the arrow "C." In this manner, a container according to the present invention may be opened and closed several times for repeated use for food storage, preparation, and consumption. The closure flap 42 may optionally be provided with a tab 62 for insertion into a slot 64 located in the top panel 46, as shown in FIG. 4, to cause an even more secure closure—for use, for example, when the container 10 is expected to be jostled around excessively.

Figure 5:
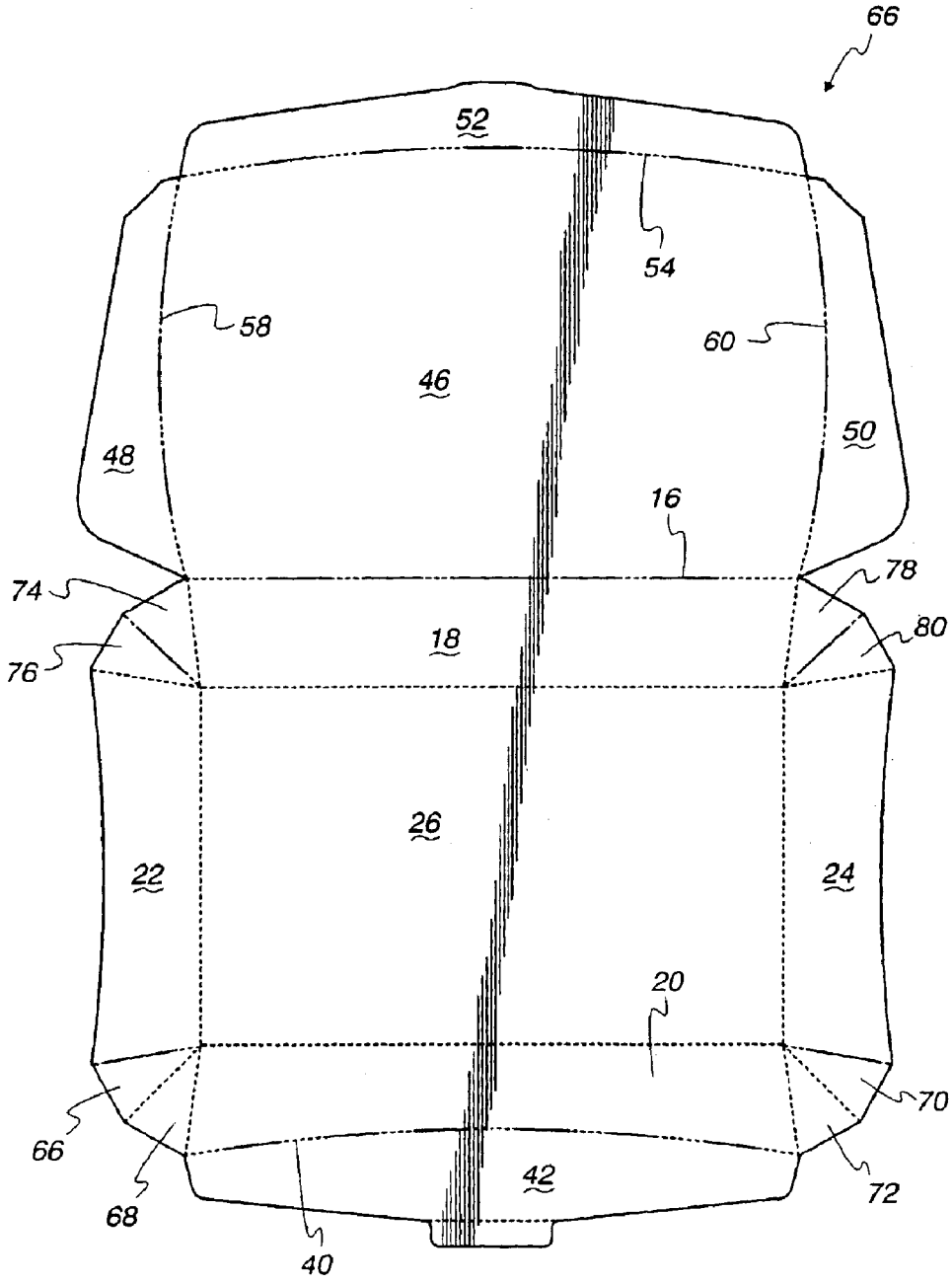
FIG. 5 is a plan view of a blank for manufacturing a container according to one embodiment of the present invention.

Turning now to FIG. 5, a plan view of a blank 66 for forming a container 10 according to the present invention is shown. In addition to the panels and fold lines discussed above, FIG. 5 shows corner structure panels 66 and 68, which form the first front corner structure 28, corner structure panels 70 and 72, which form the second front corner structure 30, corner structure panels 74 and 76, which form the first back corner structure 32, and corner structure panels 78 and 80, which form the second back corner structure 34 when the blank 66 is assembled into the container 10.

According to one embodiment of the present invention, in forming the blank 66 into the container 10, the corner structures are first formed by folding the respective pairs of corner structure panels toward each other, then adhering the resulting corner structures to their respective first and second side panels 22 and 24. For example, the first front corner structure 28 is formed by folding the corner structure panels 66 and 68 toward each other, then folding the structure toward the first side panel 22 and adhering the structure to outside of the first side panel 22. A similar procedure is followed for the remaining corner structures, resulting in sturdy corner structures which resist deformation when the container 10 is formed. It is to be understood that the corner structures could also be folded inwardly and attached to the insides of the side panels 22 and 24, or that they could be folded either inwardly or outwardly and attached to either the inside or outside of the back and front panels 18 and 20, or a combination of these methods could be used.

Once the corner structures are assembled, the base 12 of the container 10 has been given its basic structural form. Next, the first and second minor side flaps 48 and 50 and the minor front flap 52 are folded inwardly and the top panel 46 is folded downwardly over the base 12. Finally, to close the package, the closure flap 42 is folded over the top panel 46.

A container according to the present invention may be manufactured using a variety of methods and materials. One preferred material for manufacture of a container according to the present invention is paperboard coated with water-resistant polymer along one side. According to one embodiment of the present invention, a polymer coating is provided along the inside surfaces of the container. Further, using a container according to the present invention, it is possible to elevate the pressure inside the container above atmospheric pressure.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A reclosable container comprising:

a base having a bottom panel, a front panel, a back panel, and first and second side panels extending upwardly from said bottom panel, said back panel terminating along a top edge at a hinge fold line;

a lid attached to said hinge fold line, said lid having a top panel, first and second minor side flaps, and a minor front flap, said first and second minor side flaps respectively attached to said top panel along first and second curved minor side flap fold lines, said minor front flap attached to said top panel along a curved minor from flap fold line, said lid being repeatedly movable between an open and a closed position; and a closure flap attached along a top of said front panel along a curved closure flap fold line, said closure flap being repeatedly movable between an open and a closed position.

2. The container of claim 1 wherein said front panel, said back panel, and said first and second side panels extend upwardly from said bottom panel at angles from about 90 degrees to about 120 degrees.

3. The container of claim 1 wherein said closure flap has a tab and said top panel has a slot, said slot being positioned to accept said tab when said closure flap is in said closed position.

4. The container of claim 1 wherein said hinge fold line is provided with scored areas such that said lid tends to fold inwardly over said base rather than outwardly.

5. The container of claim 1 wherein said first and second side panels and said front and back panels meet at corners, said corners being reinforced with corner structures.

6. The container of claim 5 wherein said corner structures contain at least three plies of material.

7. A blank for forming a container comprising:

a bottom panel;

first and second side panels attached to said bottom panel along first and second side panel fold lines;

a back panel attached to said bottom panel along a back panel fold line;

a front panel attached to said bottom panel along a front panel fold line;

a closure flap attached to said front panel along a curved closure flap fold line; and a top panel attached to said back panel along a hinge fold line.

8. The blank of claim 7 wherein said curved closure flap fold line is concave with respect to said closure flap.

9. The blank of claim 7 further comprising first and second minor side flaps attached to said top panel along first and second curved minor side flap fold lines and a minor front flap attached to said top panel along a curved minor front flap fold line.

10. A method of constructing a container comprising:

providing a blank comprising a bottom panel; first and second side panels attached to said bottom panel along first and second side panel fold lines; a back panel attached to said bottom panel along a back panel fold line; a front panel attached to said bottom panel along a front panel fold line; a closure flap attached to said front panel along a curved closure flap fold line; and a top panel attached to said back panel along a hinge fold line;

folding said first and second side panels upwardly respectively along said first and second side panel fold lines;

folding said front panel upwardly along said front panel fold line;

folding said back panel upwardly along said back panel fold line;

folding said top panel inwardly along said hinge fold line; and folding said closure flap over said top panel along said curved closure flap fold line.

11. A method of constructing a container comprising:

providing a blank comprising: a bottom panel; first and second side panels attached to said bottom panel along first and second side panel fold lines; a back panel attached to said bottom panel along a back panel fold line; a front panel attached to said bottom panel along a front panel fold line; a closure flap attached to said front panel along a curved closure flap fold line; a top panel attached to said back panel along a hinge fold line; first and second minor side flaps attached to said top panel along first and second curved minor side flap fold lines; a minor front flap attached to said top panel along a curved minor front flap fold line; and four pairs of corner structure panels provided between each of said back panel and said first side panel, said back panel and said second side panel, said front panel and said first side panel, and said front panel and said second side panel;

folding said first and second side panel upwardly respectively along said first and second side panel fold lines;

folding said front panel upwardly along said front panel fold line;

folding said back panel upwardly along said back panel fold line;

folding said four pairs of corner structure panels along respective ones of said first and second side panels;

folding said first minor side flap inwardly along said first curved minor side flap fold line;

folding said second minor side flap inwardly along said second curved minor side flap fold line;

folding said minor front flap inwardly along said curved minor front flap fold line;

folding said top panel inwardly along said hinge fold line; and folding said closure flap over said top panel along said curved closure flap fold line.

12. The method of claim 11 further comprising adhering said corner structure panels to respective ones of said first and second side walls.

13. A method for using a container comprising:

providing a container comprising:

a base having a bottom panel, a front panel, a back panel, and first and second side panels extending upwardly from said bottom panel, said back panel terminating along a top edge at a hinge fold line;

a lid attached to said hinge fold line, said lid having a top panel, first and second minor side flaps, and a minor front flap, said first and second minor side flaps respectively attached to said top panel along first and second curved minor side flap fold lines, said minor front flap attached to said top panel along a curved minor front flap fold line; and a closure flap attached along a top of said front panel along a curved closure flap fold line;

grasping said closure flap;

moving said closure flap from a closed position to an open position by folding said closure flap outwardly along said curved closure flap fold line; and moving said lid from said closed position outwardly to an open position by folding said lid along said hinge fold line.

14. The method of claim 13 further comprising:

reclosing said container by moving said lid from said open position inwardly to a closed position by folding said lid along said hinge fold line, and moving said closure flap from said open position to said closed position by folding said closure flap inwardly along said curved closure flap fold line.

15. A reclosable container comprising:

a base having a bottom panel, a front panel, a back panel, and first and second side panels extending upwardly from said bottom panel, said back panel terminating along a top edge at a hinge fold line;

a lid attached to said hinge fold line, said lid having a top panel, first and second minor side flaps, and a minor front flap, said first and second minor side flaps respectively attached to said top panel along first and second curved minor side flap fold lines, said minor front flap attached to said top panel along a curved minor front flap fold line; and a closure flap attached along a top of said front panel along a curved closure flap fold line;

wherein said first and second side panels and said front and back panels meet at corners, said cowers being reinforced with corner structures.

* * * * *

UNITED STATES PATENT AND TRADEMARK OFFICE

CERTIFICATE OF CORRECTION

PATENT NO. : 6,863,212 B2
DATED : March 8, 2005
INVENTOR(S) : James L. Stone et al.

It is certified that error appears in the above-identified patent and that said Letters Patent is hereby corrected as shown below:

Column 4,
Line 51, “a curved minor from” should read -- a curved minor front --.

Column 5,
Line 63, “first and second side panel” should read -- first and second side panels --.

Column 6,
Line 62, “said cowers being” should read -- said corners being --.

Signed and Sealed this

Twenty-fourth Day of May, 2005

JON W. DUDAS
*Director of the United States Patent and Trademark Office*